US009086712B2

(12) United States Patent
Fefer et al.

(10) Patent No.: US 9,086,712 B2
(45) Date of Patent: Jul. 21, 2015

(54) DEVICE AND METHOD FOR COMPENSATING FOR VOLTAGE DROPS

(71) Applicants: Yehim-Haim Fefer, Petah-Tikva (IL); Sergey Sofer, Reshon Letzion (IL)

(72) Inventors: Yehim-Haim Fefer, Petah-Tikva (IL); Sergey Sofer, Reshon Letzion (IL)

(73) Assignee: Freesacle Semiconductor, Inc., Austin, TX (US)

( * ) Notice: Subject to any disclaimer, the term of this patent is extended or adjusted under 35 U.S.C. 154(b) by 0 days.

(21) Appl. No.: 14/483,899

(22) Filed: Sep. 11, 2014

(65) Prior Publication Data

US 2015/0002218 A1 Jan. 1, 2015

Related U.S. Application Data

(63) Continuation of application No. 12/093,939, filed as application No. PCT/IB2005/053754 on Nov. 15, 2005, now Pat. No. 8,836,414.

(51) Int. Cl.
*G05F 1/46* (2006.01)
*G05F 1/565* (2006.01)

(52) U.S. Cl.
CPC ..... *G05F 1/465* (2013.01); *G05F 1/565* (2013.01)

(58) Field of Classification Search
CPC ..... G05F 1/465; G05F 1/467; G05F 1/565
See application file for complete search history.

(56) References Cited

U.S. PATENT DOCUMENTS 5,942,809 A 8/1999 Hashimoto
6,025,703 A 2/2000 Bjorkengren et al.
6,040,639 A 3/2000 Ginell et al.
6,044,639 A 4/2000 Weeger et al.
6,058,257 A 5/2000 Nojima
6,177,783 B1 1/2001 Donohue
6,310,511 B1 * 10/2001 Weinfurtner ..... 327/540
6,459,335 B1 10/2002 Darmawaskita et al.
6,538,497 B2 3/2003 Thomas et al.
6,753,722 B1 6/2004 Kondapalli et al.
6,791,302 B2 9/2004 Tang et al.
6,809,577 B2 * 10/2004 Matsumoto et al. ..... 327/541
6,906,582 B2 6/2005 Kase et al.
7,135,842 B2 11/2006 Banerjee et al.

(Continued)

FOREIGN PATENT DOCUMENTS

JP 05-021738 1/1993
JP 2000268562 9/2000

OTHER PUBLICATIONS

International Search Report mailed Aug. 30, 2006 for International Application No. PCT/IB2005/053754, 2 pages.

*Primary Examiner* — Thomas J Hiltunen

(57) ABSTRACT

A device that includes at least one current consuming component. The device is characterized by including a compensation circuit adapted to compare between a voltage level at a sensing point within an integrated circuit and between a reference voltage derived from a voltage peak level at the sensing point; and to selectively increase the voltage at the sensing point in response to the comparison. A method for compensating for voltage drops in an integrated circuit, the method includes providing at least a first supply voltage to an integrated circuit; the method is characterized by including: comparing between a voltage level at a sensing point within an integrated circuit to a reference voltage derived from a voltage peak level at the sensing point; and selectively increasing the voltage at the sensing point in response to the comparison.

20 Claims, 9 Drawing Sheets

(56) References Cited

U.S. PATENT DOCUMENTS

| | | | | |
|---|---|---|---|---|
| 7,274,113 | B2 | 9/2007 | Ebata | |
| 7,298,200 | B2 * | 11/2007 | Won | 327/541 |
| 7,397,226 | B1 | 7/2008 | Mannama et al. | |
| 7,449,972 | B2 * | 11/2008 | Juang et al. | 331/182 |
| 7,940,032 | B2 * | 5/2011 | Kim et al. | 323/283 |
| 7,956,594 | B2 | 6/2011 | Sofer et al. | |
| 8,564,360 | B2 | 10/2013 | Kwon et al. | |
| 8,836,414 | B2 * | 9/2014 | Fefer et al. | 327/540 |
| 2004/0030511 | A1 | 2/2004 | Tien et al. | |
| 2004/0049752 | A1 | 3/2004 | Iwanishi et al. | |
| 2004/0108889 | A1 | 6/2004 | Kizaki et al. | |
| 2004/0238850 | A1 | 12/2004 | Kusumoto | |
| 2005/0168271 | A1 | 8/2005 | Brox | |
| 2005/0184799 | A1 | 8/2005 | Kii | |
| 2005/0248391 | A1 * | 11/2005 | Itoh | 327/540 |
| 2006/0152295 | A1 | 7/2006 | Miyashita et al. | |
| 2006/0244512 | A1 | 11/2006 | Fung et al. | |

* cited by examiner

DEVICE AND METHOD FOR COMPENSATING FOR VOLTAGE DROPS

CROSS REFERENCE TO RELATED APPLICATION(S)

The present application is a continuation of U.S. patent application Ser. No. 12/093,939, entitled "Device and Method for Compensating for Voltage Drops," filed on Jun. 21, 2014, which is a National Stage Entry under 37 C.F.R. §371 of PCT/IB2005/053754, filed Nov. 15, 2005, the disclosures of which are hereby expressly incorporated by reference in their entirety.

FIELD OF THE INVENTION

The present invention relates to devices and methods for compensating for voltage drops within an integrated circuit.

BACKGROUND OF THE INVENTION

Modern integrated circuits are required to operate in very high frequencies while consuming a relatively limited amount of voltage. In order to reduce the power consumption of modern integrated circuits the level of supply voltage has dramatically decreased during the last decade.

This supply voltage reduction has some drawbacks such as an increased sensitivity to voltage drops (also referred to as IR drops or droops) that are proportional to the current (I) consumed by the integrated circuit and to the resistance (R) of the conductors that are connected to the integrated circuit as well as to conductors that are located inside the integrated circuit.

A voltage drop reduces the voltage that is provided to internal components of the integrated circuit and thus can temporarily prevent the integrated circuit from operating in a proper manner.

U.S. Pat. No. 6,058,257 of Nojima, and U.S. patent application publication number 2004/0238850 of Kusumoto, both being incorporated herein by reference, describe apparatuses, devices and methods for designing an integrated circuit such as to reduce internal voltage drops.

U.S. patent application publication number 2004/0030511 of Tien et al., being incorporated herein by reference, describes a method for evaluating (by using simulations) voltage drops.

U.S. patent application 2004/0049752 of Iwanishi et al., being incorporated herein by reference, describes an integrated circuit design process that is responsive to voltage drops.

Japanese patent application JP05021738 titled "A semiconductor integrated circuit", being incorporated herein by reference, describes an apparatus that increases the supply voltage by a predetermined amount and during a predefined period once a certain event is detected.

U.S. Pat. Nos. 6,044,639 and 6,538,497, being incorporated herein by reference, illustrate various prior art devices and methods for compensating for IR drops.

There is a need to provide a device and method for efficiently compensating for voltage drops.

SUMMARY OF THE PRESENT INVENTION

A device and a method for compensating for voltage drops, as described in the accompanying claims.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

Figure 1:
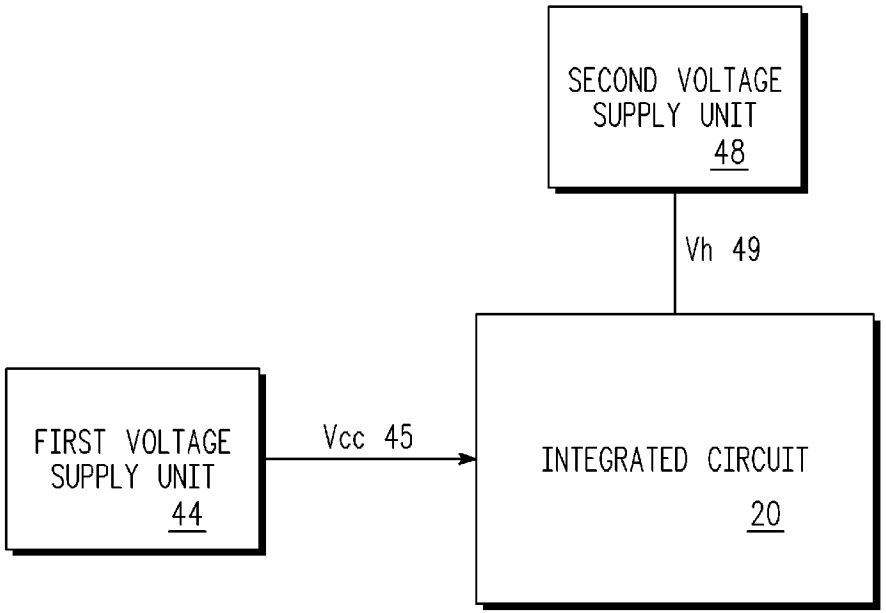
FIG. 1 illustrates a device, according to an embodiment of the invention.

The following figures illustrate exemplary embodiments of the invention. They are not intended to limit the scope of the invention but rather assist in understanding some of the embodiments of the invention. It is further noted that all the figures are out of scale.

According to various embodiments of the invention a method and device for compensating for voltage drops are provided. The compensation can involve comparing the voltage at a sensing point to a maximal voltage level (also referred to as peak voltage level) measured at this sensing point and increasing the voltage of that point when a voltage drop is detected. Conveniently, the peak voltage level represents the maximal value of the voltage at the sensing point within a peak measurement period. Conveniently, the detection and voltage increment are relatively fast, in comparison to the development of the IR drop and especially in relation to a response period of an external voltage supply unit.

According to an embodiment of the invention the compensation can involve applying a fast compensation scheme (that can involve using internal components of the integrated circuit) as well as applying a slower compensation scheme that can involve adjusting a supply voltage supplied by a voltage supply unit in response to sampled voltages derived from the voltage at the sensing point.

Conveniently, the compensation circuit uses an I/O type transistor as a switch that can be opened such as to provide current from another voltage supply that is used for additional purposes and provides a second supply voltage that is higher then the first supply voltage.

Conveniently, multiple sensing points are defined within an integrated circuit and each sensing point can be connected to its own compensation circuit, and/or to a feedback path towards the voltage supply unit.

According to various embodiments of the invention the peak voltage level is a maximal level of a voltage at a sensing point. The peak voltage level can be detected during a peak measurement period. The period can be a fixed period or can vary. Conveniently, the voltage peak level at a certain time represents the maximal voltage level within a predefined time window that ends at that certain time. This technique can be referred to as a sliding window technique.

According to an embodiment of the invention the compensation circuit includes a timeout circuit that terminates any voltage increment after a predefined timeout period expires. This timeout period can correspond to a response period of the feedback loop and the voltage supply unit.

Conveniently, the method and device can be implemented by using standard components such as a I/O type transistor, as well as make use of a I/O voltage supply unit that is used to supply a supply voltage to I/O pads used for interfacing an integrated circuit to external world.

Conveniently the method includes: (i) providing at least a first supply voltage to an integrated circuit; (ii) comparing between a voltage level at a sensing point within an integrated circuit to a reference voltage derived from a voltage peak level, at the sensing point; and (iii) selectively increasing the voltage at the sensing point in response to the comparison.

Conveniently, a device is provided. The device can include at least one current consuming component (such as but not limited to a core or a memory or peripheral unit). The device also includes a compensation circuit that is adapted to compare between a voltage level at a sensing point within an integrated circuit and between a reference voltage derived from a voltage peak level at the sensing point; and to selectively increase the voltage at the sensing point in response to the comparison.

FIG. 1 illustrates a device 10, according to an embodiment of the invention. Device 20 can include one or more integrated circuits, and can include one or more voltage supply units, can be a mobile device such as but not limited to a cellular phone, a laptop computer, a personal data accessory and the like. For convenience of explanation only a first voltage supply unit 44, a second voltage supply unit 48 and a single integrated circuit 20 are illustrated.

The first voltage supply unit 44 provides a first supply voltage Vcc 45 while the second voltage supply unit provides a higher supply voltage Vh 49. Conveniently Vh 49 is supplied to various I/O ports and/or peripherals such as peripherals 26 of FIG. 2.

The first voltage supply unit 44 can include regulating elements, voltage limiting circuitry, and the like. It conveniently includes a voltage adjustment unit that can be responsive to feedback signals provided from the integrated circuit 20. The first voltage supply unit 44 usually includes smoothing components such as filters and/or capacitors that smooth the first supply voltage Vcc 45. The first voltage supply unit 44 can receive feedback from the integrated circuit 20 and accordingly alter the first supply voltage Vcc that is provided to the integrated circuit 20. The adjustment period is usually long, thus one or more compensation circuits (such as circuit 90 of FIG. 3) is included within integrated circuit 20. Conveniently, once (or shortly after) an adjusted first supply voltage ends is provided to the integrated circuit 20 the compensation circuit 90 can cease to compensate for the voltage drop.

Figure 2:
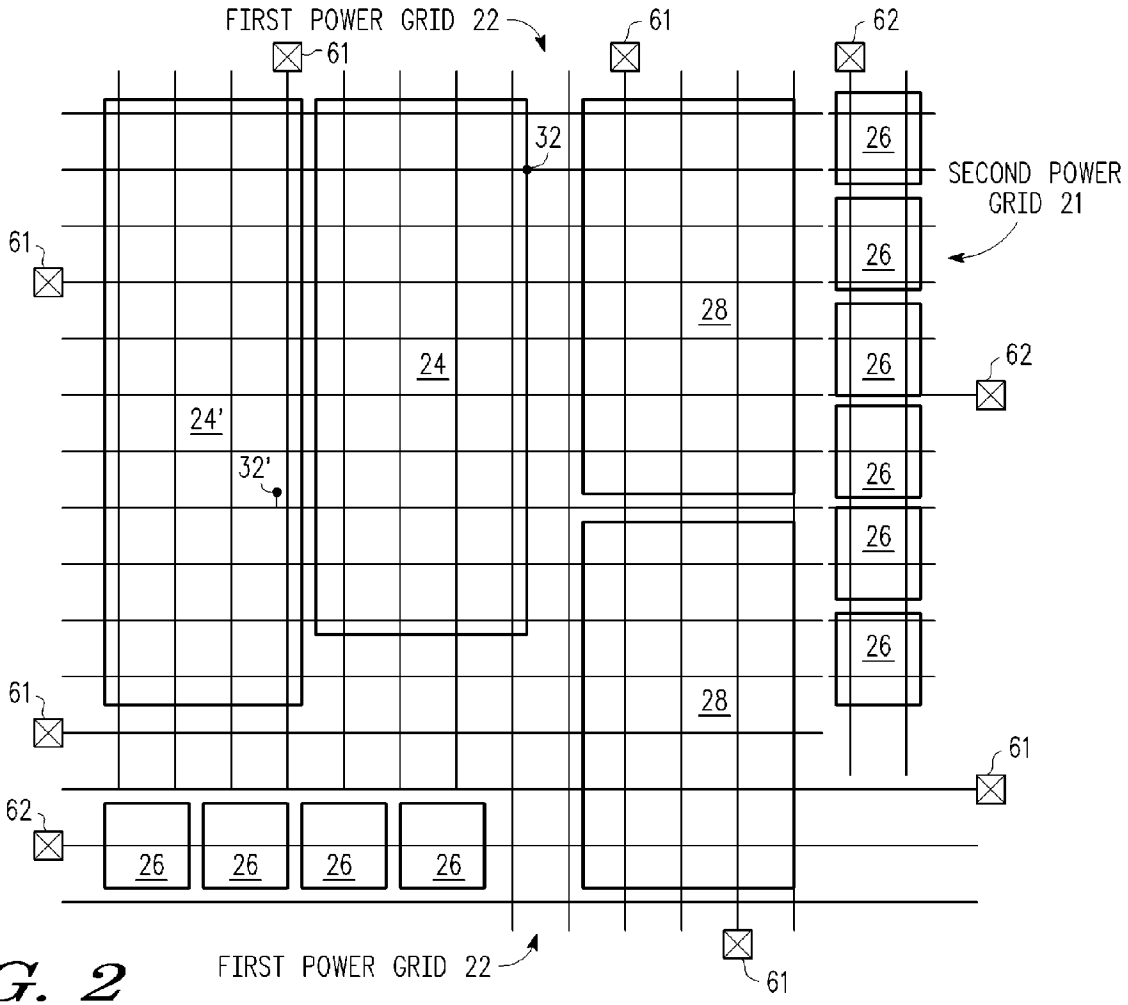
FIG. 2 illustrates various portions of an integrated circuit, according to an embodiment of the invention.

FIG. 2 illustrates various portions of an integrated circuit 20, according to an embodiment of the invention.

Integrated circuit 20 includes a first supply voltage network such as but not limited to first grid 22 and a second supply voltage network such as but not limited to a second grid 21. It also includes multiple components such as cores 24 and 24', peripherals (I/O pads etc.) 26 and memory units 28 and 28'. The first voltage supply grid 22 is connected to one or more pins 61. The second voltage supply grid 21 is connected to one or more pins 62. Pins 61 are connected to the first voltage supply unit 44 while pins 62 are connected to the second voltage supply grid 21. It is noted that the voltage supply grid is also referred to as a power grid or supply grid.

The first power supply grid 22 is connected to core 24, core 24', memory unit 28 and memory unit 28'. The second power supply grid 21 is connected to peripherals 26. It is noted that at least one component can be fed by both power grids, but this is not necessarily so.

Two exemplary, non-limiting and out of scale sensing points 32 and 32' are also illustrated. Sensing point 32 is positioned within the area of core 24 while sensing point 32' is located within core 24'. It is noted that much more than a pair of sensing points can be defined within integrated circuit 20. It is further noted that sensing points can be located within other components of the integrated circuit 20 as well as between components of the integrated circuit 20.

Internal voltage drops are formed when one or more of these components consumes current, and especially when such a component consumes a substantial amount of current. Such a current consumption is usually associated with complex computational tasks, memory transfer bursts and the like.

The multiple sensing points are selected such as to measure these substantial voltage drops. The selection is usually based upon a simulation of the integrated circuit. Designers are usually well aware of the possible current consuming components. Typically, more than a single sensing point is positioned near a single core. In addition, at least one sensing point can be located in substantially the center of the integrated circuit, or in locations that are relatively far from pins 61 and 62.

Figure 3:
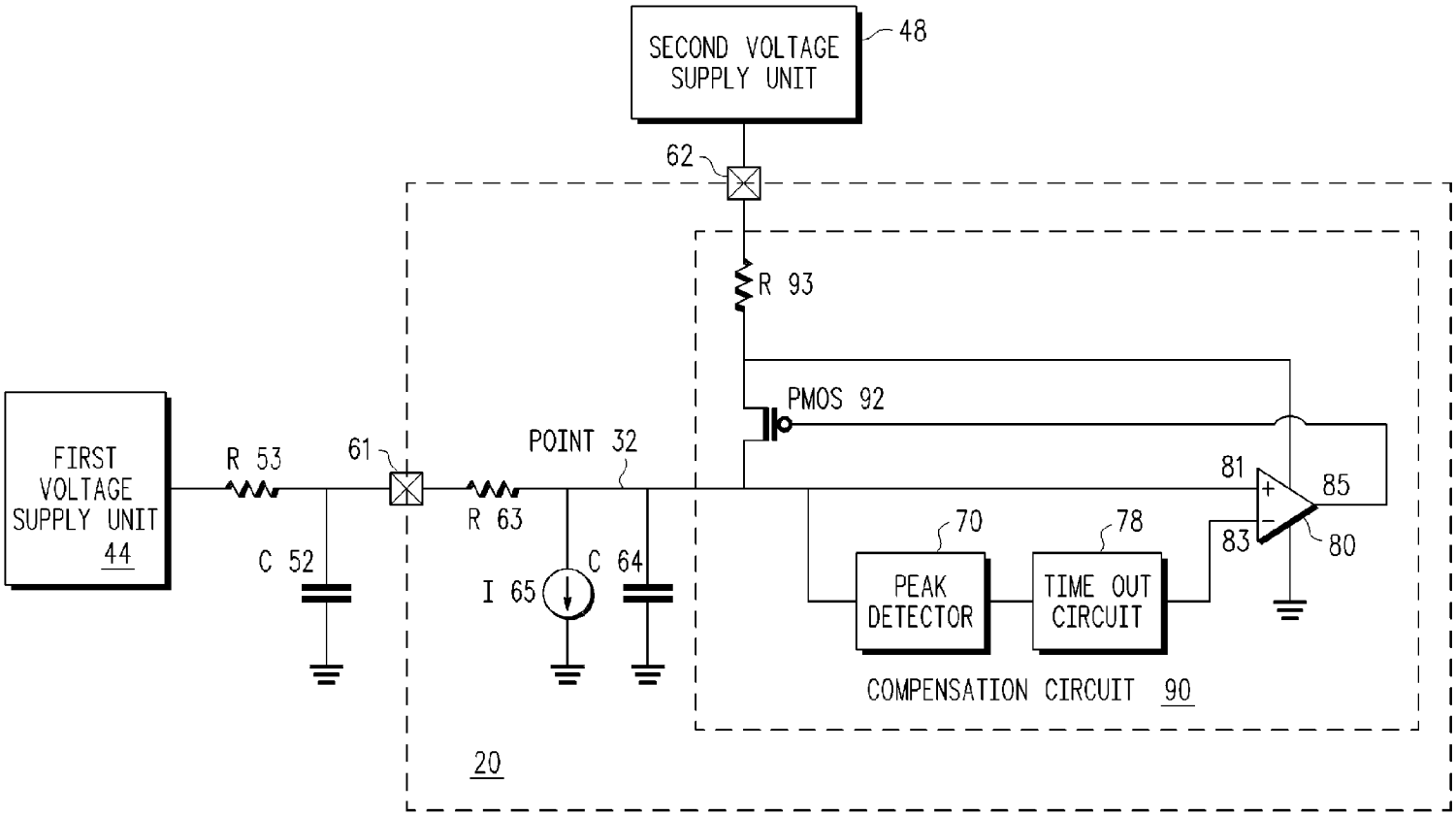
FIG. 3 is a schematic electric diagram of a compensation circuit as well as various equivalent components according to an embodiment of the invention.

FIG. 3 is a schematic electric diagram of a compensation circuit 90 as well as various equivalent components 53-65 and 93, according to an embodiment of the invention.

FIG. 3 illustrates various components such as power transistor 92, peak detector 70, timeout circuit 78, comparator 80, pins 61 and 62 and first and second voltage supply units 44 and 48.

FIG. 3 also illustrates equivalent components that represent the resistance (represented by resistors 53, 63 and 93), capacitances (represented by capacitors 52 and 64) and current consumption (represented by current drain 65) of various components as well as conductors of the integrated circuit and various conductors connected to the first and second voltage supply units 44 and 48.

Resistor 53 represents the impedance of the interconnect lines (conductors) between the first voltage supply unit 44 and one or more pins 61 of integrated circuit 20. Capacitor 52 represents the capacitance of these conductors as well as an output capacitance of the first voltage supply unit 44, as viewed from one or more pins 61 of integrated circuit 20.

Resistor 63 represents the resistance of the first voltage supply grid 22 between pin 61 and sensing point 32. Resistor 93 represents the resistance of the second voltage supply grid 21 between pin 62 and sensing point 32. Capacitor 64 represents the equivalent capacitance of the integrated circuit as viewed from sensing point 32. Current sink 65 represents the current consumption of one or more components of integrated circuit 20, as viewed from sensing point 32.

The peak detector 70 detects the maximal value of the voltage at sensing point 32. This maximal value is measured during a peak measurement period. The peak detector is connected to a timeout circuit 78 that is capable of stopping a voltage compensation period after a timeout period expires.

Conveniently the timeout circuit 78 outputs a reference voltage that is responsive to the peak voltage level. Conveniently the reference voltage generated by the peak detector 70 is gradually decremented so that the voltage compensation session stops after a predefined timeout period. Resistor 53 is connected between the first voltage supply unit 44 and pin 61. Capacitor 52 is connected between the ground and pin 61. Resistor 63 is connected between pin 61 and sensing point 32. Sensing point 32 is also connected to a first end of current drain 65, to a first end of capacitor 64, to a drain of PMOS 92, to a non-inverting input 81 of comparator 80 and to an input of peak detector 70.

The other end of capacitor 64 and current drain 65 are grounded. The output of peak detector 70 is connected to an input of timeout circuit 78. The output of timeout circuit 78 is connected to an inverting input 83 of comparator 80. The output 85 of comparator 80 is connected to a gate of power transistor 92 so that it opens PMOS 92 when a voltage drop is detected. The source of PMOS 92 is connected, via resistor 93 and pin 62 to the second supply unit 48.

PMOS 92, comparator 80, peak detector 70 and timeout circuit 78 form a compensation circuit 90. This circuit is characterized by a fast response period, in comparison to the development of the voltage (IR) drop evolution and especially in relation to a response period of the first voltage supply unit 44. It is noted that slow compensation circuits can also be used, but a gap resulting from their slow response can require to supply a higher first supply voltage or to hamper the performance of integrated circuit 20.

For simplicity of explanation the equivalent capacitance and resistance of the second power supply unit 48 as well as the resistance and capacitance of connectors that connect it to pin 62 are not shown.

Conveniently, multiple sensing points can be connected to one or more current consuming components of integrated circuit 20, such as cores 24 and 24'.

Figure 4:
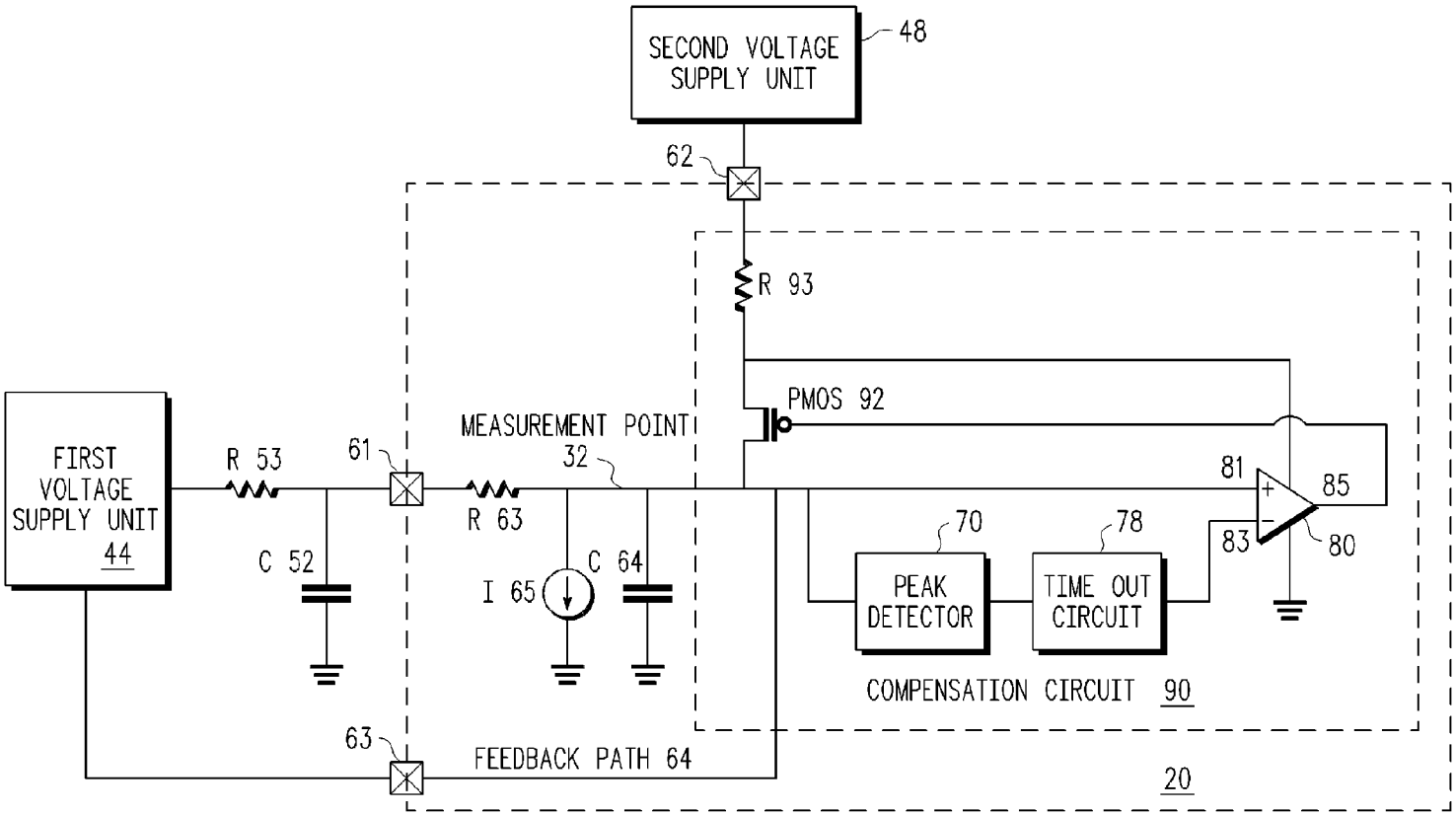
FIG. 4 is a schematic electric diagram of a compensation circuit as well as various equivalent components according to another embodiment of the invention.

When core 24 consumes more current (the current drained by current drain 65 increases) the voltage at the sensing point 32 decreases due to a voltage that is developed over resistors 63 and 53 and due to a discharge of capacitor 64. It is assumed that because of this voltage drop the reference voltage provided to the inverting input 83 of comparator 80 is higher then the voltage provided to the non-inverting input 81 of comparator 80. In response, comparator 80 opens PMOS 92 that provides a current from the second voltage supply unit 48. This current slows down or stops the discharge of capacitor 64 and can even charge it. When the core 24 reduces its current consumption or the capacitor 64 is charged back to its initial voltage (within a detectable voltage error). FIG. 4 is a schematic electric diagram of a compensation circuit 90 as well as various equivalent components according to another embodiment of the invention. The circuit illustrated in FIG. 4 differs from the circuit of FIG. 3 by including a feedback path 62 from integrated circuit 20 to the first voltage supply unit 44. The feedback path 62 usually includes a sampling unit (such as sampling unit 30 of FIG. 7) and one or more conductors. The sampling unit can send analog signals and/or digital signals representative of the voltage at sensing point 32. The first voltage supply unit 44 can adjust the first supply voltage Vcc 45 provided to the integrated circuit 20 in order to compensate form voltage drops.

Figure 5:
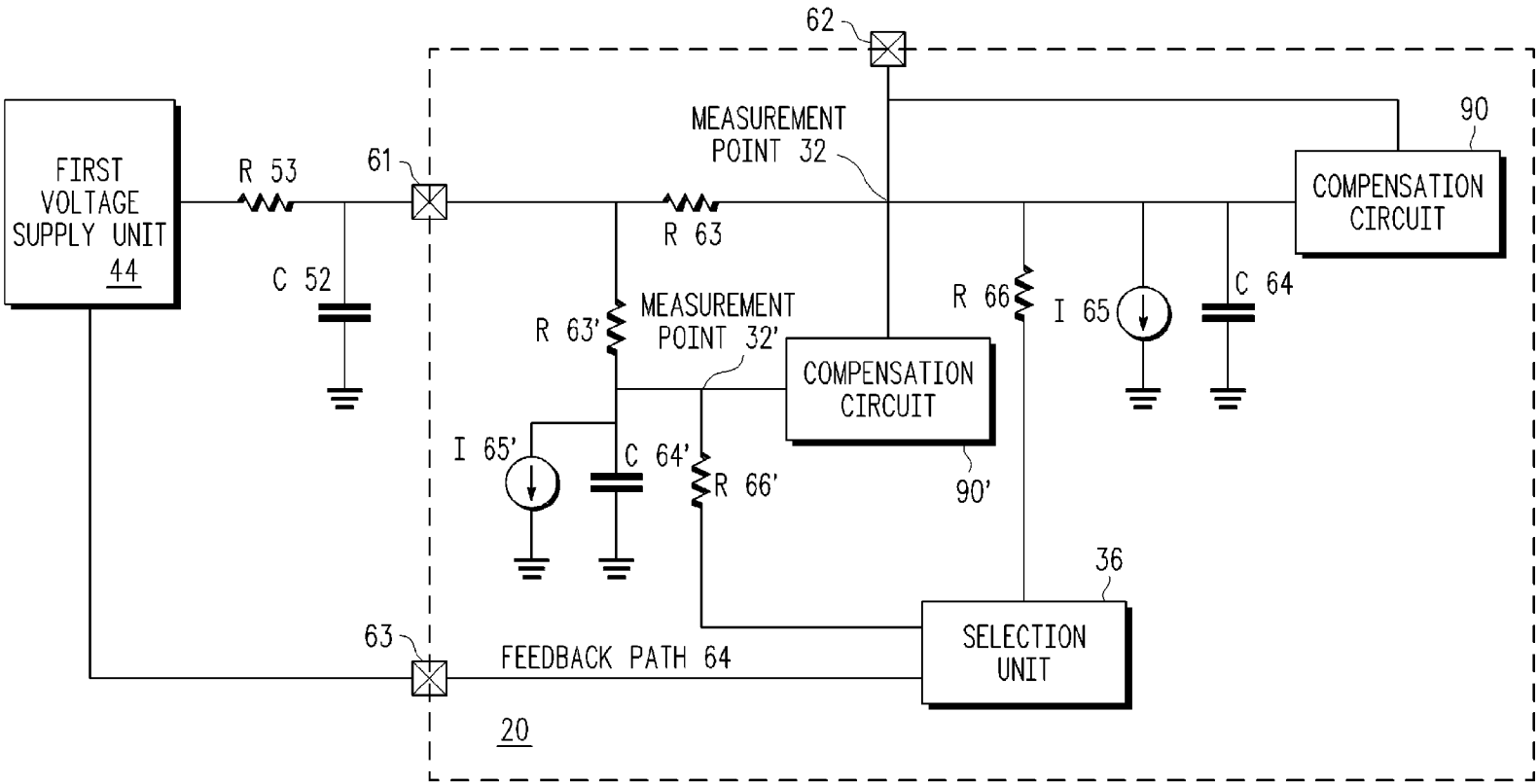
FIG. 5 is a schematic electric diagram of a two compensation circuits, a selection circuit and various equivalent components according to an embodiment of the invention.

FIG. 5 is a schematic electric diagram of two compensation circuits 90 and 90', a selection circuit 36 and various equivalent components according to an embodiment of the invention.

Conveniently, voltage drops at each of the sensing point 32 and 32' can be independently compensated by a compensation circuit (such as circuits 90 and 90') and, alternatively or additionally by a feedback path that can cause the first voltage supply unit 44 to adjust the first supply voltage Vcc.

According to an embodiment of the invention the feedback path can send sampled voltages (or signals representative of the sampled voltages) from sensing points 32 and 32' to the first voltage supply unit 44. According to another embodiment of the invention only a subset of the sampled voltages is sent to the first voltage supply unit 44. This subset is selected by a selection unit 36.

FIG. 5 illustrates various components such as compensation circuit 90, compensation circuit 90', selection unit 36, pins 61 and 62 and first and second voltage supply units 44 and 48. FIG. 5 also illustrates equivalent components that represent the resistance (represented by resistors 53, 63, 63', 66 and 66'), capacitances (represented by capacitors 52, 64 and 64') and current consumption (represented by current drains 65 and 65') of various components as well as conductors of the integrated circuit and various conductors connected to the first and second voltage supply units 44 and 48.

Resistor 53 is connected between the first voltage supply unit 44 and pin 61. Capacitor 52 is connected between the ground and pin 61. Resistor 63 is connected between pin 61 and sensing point 32. Sensing point 32 is also connected to compensation circuit 90, to a first end of current drain 65, to a first end of resistor 66 and to a first end of capacitor 64. The other end of capacitor 64 and current drain 65 are grounded.

Resistor 63' is connected between pin 61 and sensing point 32'. Sensing point 32' is also connected to compensation circuit 90', to a first end of current drain 65', to a first end of resistor 66' and to a first end of capacitor 64'. The other end of capacitor 64' and current drain 65' are grounded. Selection circuit 36 is connected to resistors 66 and 66' and to pin 63. Pin 63 is connected to the first supply voltage unit 44 thus defining a feedback path 64.

The compensation circuits 90 and 90' are connected via pin 62 to the second voltage supply unit 48. Compensation circuit 90 can be analogues to compensation circuit 90', although it can differ by its timeout period as well as by the inclusion of a timeout circuit 78.

The output of peak detector 70 is connected to an input of timeout circuit 78. The output of timeout circuit 78 is connected to an inverting input 83 of comparator 80. The output 85 of comparator 80 is connected to a gate of PMOS 92 so that it opens PMOS 92 when a voltage drop is detected. The source of PMOS 92 is connected, via resistor 93 and pin 62 to the second supply unit 48.

Typical (for a modern VLSI integrated circuit) non-limiting values of resistor 53 are 0.01-0.1 Ohm, of resistor 63 (and of resistor 63') are 0.1-10 Ohm, of resistor 66 (and resistor 66') are 10-1000 Ohm, of capacitor 52 are 100 pF-100 μF, of capacitor 64 (and capacitor 64') are 50 pF-1 nF, of current sink 65 (and of current sink 65') are 1-500 mA.

Figure 6:
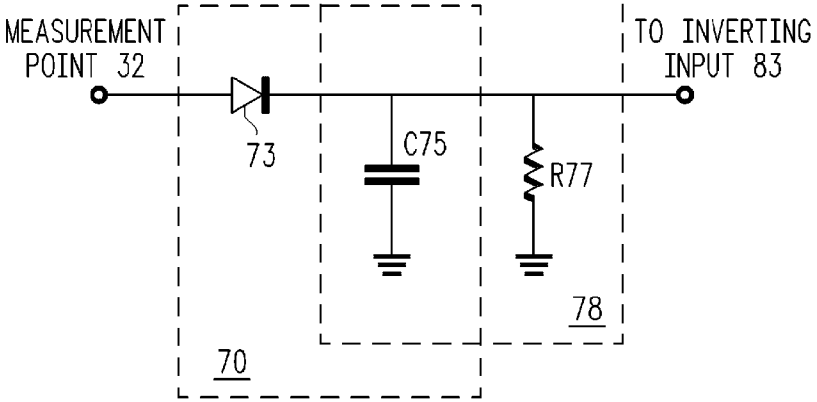
FIG. 6 illustrates a peak detector and a timeout circuit, according to an embodiment of the invention.

FIG. 6 illustrates a peak detector 70 and a timeout circuit 78, according to an embodiment of the invention.

The peak detector includes diode 73 and capacitor 75 while the timeout circuit 78 includes capacitor 75 and resistor 77. The diode charges capacitor 75. Once the capacitor 75 is charged by a peak voltage level the diode will not pass lower voltage levels. The timeout circuit 78 and especially the resistor 77 provide a discharge path to capacitor 75.

Conveniently, the timeout period is responsive to the values of capacitor 75 and resistor 77. According to an embodiment of the invention it is relatively fast in comparison to the speed of voltage scaling measures (such as DVFS). Conveniently the timeout expires once the feedback path and the first voltage supply unit 44 alter the first supply voltage in response to the voltage drop at sensing point 32.

Figure 7:
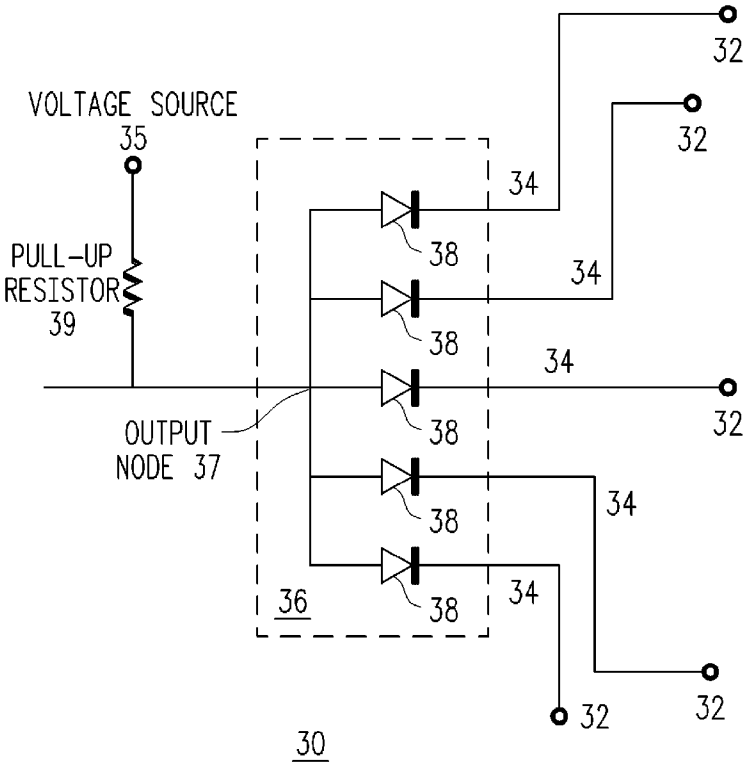
FIG. 7 illustrates a voltage sampling circuit, according to an embodiment of the invention.

FIG. 7 illustrates a voltage sampling circuit 30, according to an embodiment of the invention.

The voltage sampling unit 30 conveniently includes a selection circuit 36 that receives multiple signals from multiple measurement (or sampling) points and selects a subset of signals to be provided to the voltage supply unit 44. The selection reduces the amount of outputted signals and accordingly reduced the number of integrated circuit pins that should be allocated for outputting signals representative of the sampled voltages. It is further noted that time based multiplexing can also be used in order to reduce the amount of utilized integrate circuit pins.

Conveniently, only a single integrated circuit pin (such as pin 63 of FIG. 4) is used for outputting signal(s) representative of the sampled voltage but this is not necessarily so.

According to other embodiments of the invention the amount of integrated pins used for outputting the voltage can differ then one.

The inventors used an analog voltage sampling circuit 30 that included an analog selection circuit 36. Circuit 30 elects between multiple sampled voltages in an analog manner and outputs an analog output signal representative of at least one of the sampled voltages. Circuit 30 may be relatively simple and also sensitive to small voltage differences that can be a small fraction of the supply voltage. The inventors used a circuit that was sensitive to one percent of the supply voltage level.

The voltage sampling circuit 30 includes multiple sensing points (such as points 32 and 32'), conductors 34 that are connected to these points, and selection circuit 36 that selects a subset out of the sampled voltages to be outputted from the integrated circuit 20. Conveniently a single sampled voltage is selected.

Conveniently the voltage sampling circuit 30 consumes a negligible amount of energy and thus the voltage drop across the sampling circuit conductors (66 and 66') is also negligible. Thus, the sensing points can be located at any distance from the selection circuit 36 without substantially affecting the selection.

The voltage sampling circuit 30 outputs one or more signals representative of one or more sampled voltages. Conveniently, a single analog signal (such as the lowest voltage and/or the most significant voltage) is sent to the voltage supply unit 44. The voltage supply unit 44 then adjusts the outputted voltage in response to that (one or more) sampled voltage.

The exemplary voltage sampling circuit 30 includes multiple sensing points 32 that are connected via conductors 34 to selection circuit 36 that includes multiple diodes (active or passive) 38 and pull-up resistor 39.

The diodes 38 are connected between different conductors 34 and an output node 37. A pull up resistor 39 is connected between the output node 37 and a voltage source that provides a working point to the diodes. In case of positive voltage supply the anode of each diode is connected to a conductor while the cathodes of all diodes are connected to an output node 37 of the selection circuit 36. The pull-up resistor 36 is also connected between the output node 37 and a voltage source providing a voltage bias for correct circuit operation.

The lowest voltage is provided, by one of diodes to the output node 37 and causes the other diodes to receive a reverse bias voltage and to stop conducting.

If the selection circuit 36 should output multiple sampled voltages than the selection circuit 36 should include multiple output nodes.

Figure 8:
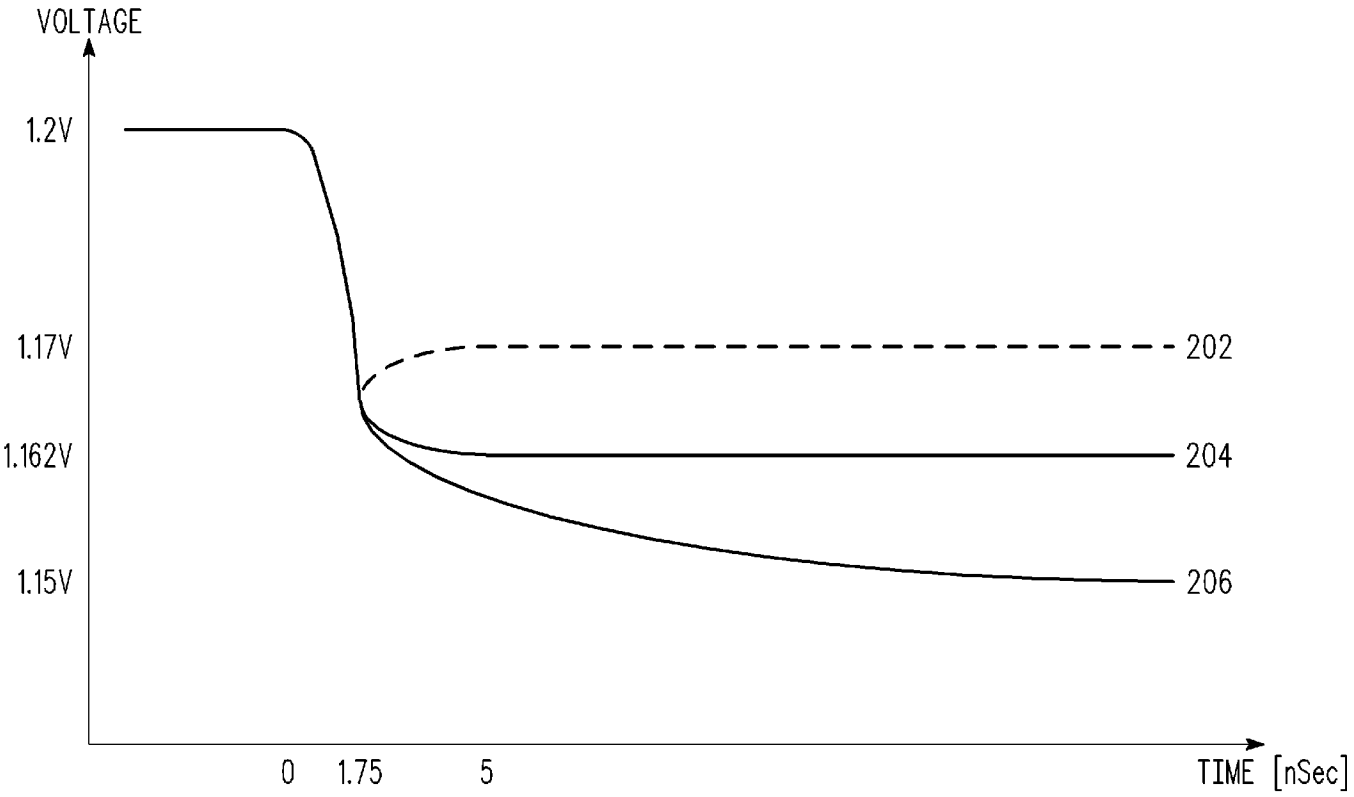
FIG. 8 illustrates voltage drop and the result of two voltage drop compensation measures, according to an embodiment of the invention.

FIG. 8 illustrates voltage drop and the result of two voltage drop compensation measures, according to an embodiment of the invention.

The various curves were simulated by the inventors are reflect only certain curves out of many possible curves. Curve 206 illustrates an exemplary voltage drop. This voltage drop is not compensated by any means. A voltage drop begins at time T=0. The voltage at sensing point 32 drops to about 1.75 nanoSeconds to about 1.165 Volts and stabilizes at a level of about 1.15 Volts after few tenths of nanoSeconds.

Curve 204 illustrates the behavior of the voltage at sensing point 32 when a PMOS with the equivalent impedance of about 50 Ohm in the "ON" state is used as switch 92. The second supply unit voltage is chosen equal to 2.5V. After about 1.75 Nanoseconds (characterizing the response period of the fast compensating circuit) the voltage reduction slows down and the voltage stabilizes at a level of about 1.162 Volts after about 5 Nano-Seconds.

Curve 202 illustrates the behavior of the voltage at sensing point 32 when a PMOS with the equivalent impedance of about 20 Ohm in the "ON" state is used as switch 92. After about 1.75 Nanoseconds the voltage reduction ends and the voltage rises to a level of about 1.17 Volts after about 5 Nano-Seconds.

Figure 9:
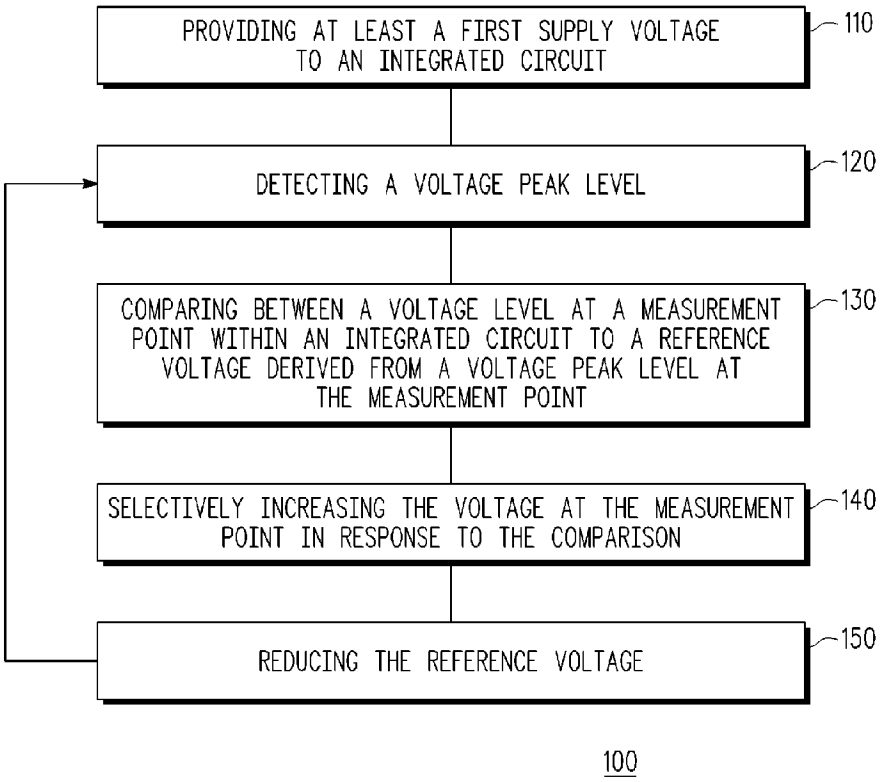
FIG. 9 is a flow chart of a method for compensating for voltage drops according to an embodiment of the invention.

FIG. 9 is a flow chart of a method 100 for compensating for voltage drops according to an embodiment of the invention.

Method 100 starts by stage 110 of providing at least a first supply voltage to an integrated circuit. Conveniently, a first supply voltage is supplied by a first voltage supply unit and a second supply voltage is supplied by a second voltage supply unit. The second supply voltage is conveniently higher than the first supply voltage.

Stage 110 is followed by stage 120 of detecting a voltage peak level at a sensing point. It is noted that the detection can occur before stage 110, after stage 110, during stage 110 and the like. The detecting can occur within a predefined measurement period, as well as within a dynamically changing measurement period. The inventors utilized a sliding window mechanism in which the voltage peak level was constantly measured. It is noted that the voltage peak level can be detected by sampling but this is not necessarily so.

Stage 120 is followed by stage 130 of comparing between a voltage level at a sensing point within an integrated circuit to a reference voltage derived from a voltage peak level at the sensing point. Conveniently, the voltage peak level is measured during a peak measurement period.

Stage 130 is followed by stage 140 of selectively increasing the voltage at the sensing point in response to the comparison. When a voltage drop is detected (for example when the voltage level at a sensing point is lower than the voltage peak level or when the voltage level at a sensing point is lower than the voltage peak level by more than a predefined threshold) the voltage is increased.

Conveniently, the voltage increment occurs by draining a current from the second voltage supply unit and charging at least one capacitor or capacitance that is discharged as a result of the voltage drop.

Conveniently the voltage can be increased until the voltage level substantially reaches the peak level.

Stage 140 is followed by stage 150 of reducing the reference voltage. This reduction stops the voltage increment after a timeout period expires. It is noted that the voltage increment can be stopped by updating the voltage peak level, by shutting down a switch that provides current to the sensing point and the like.

Figure 10:
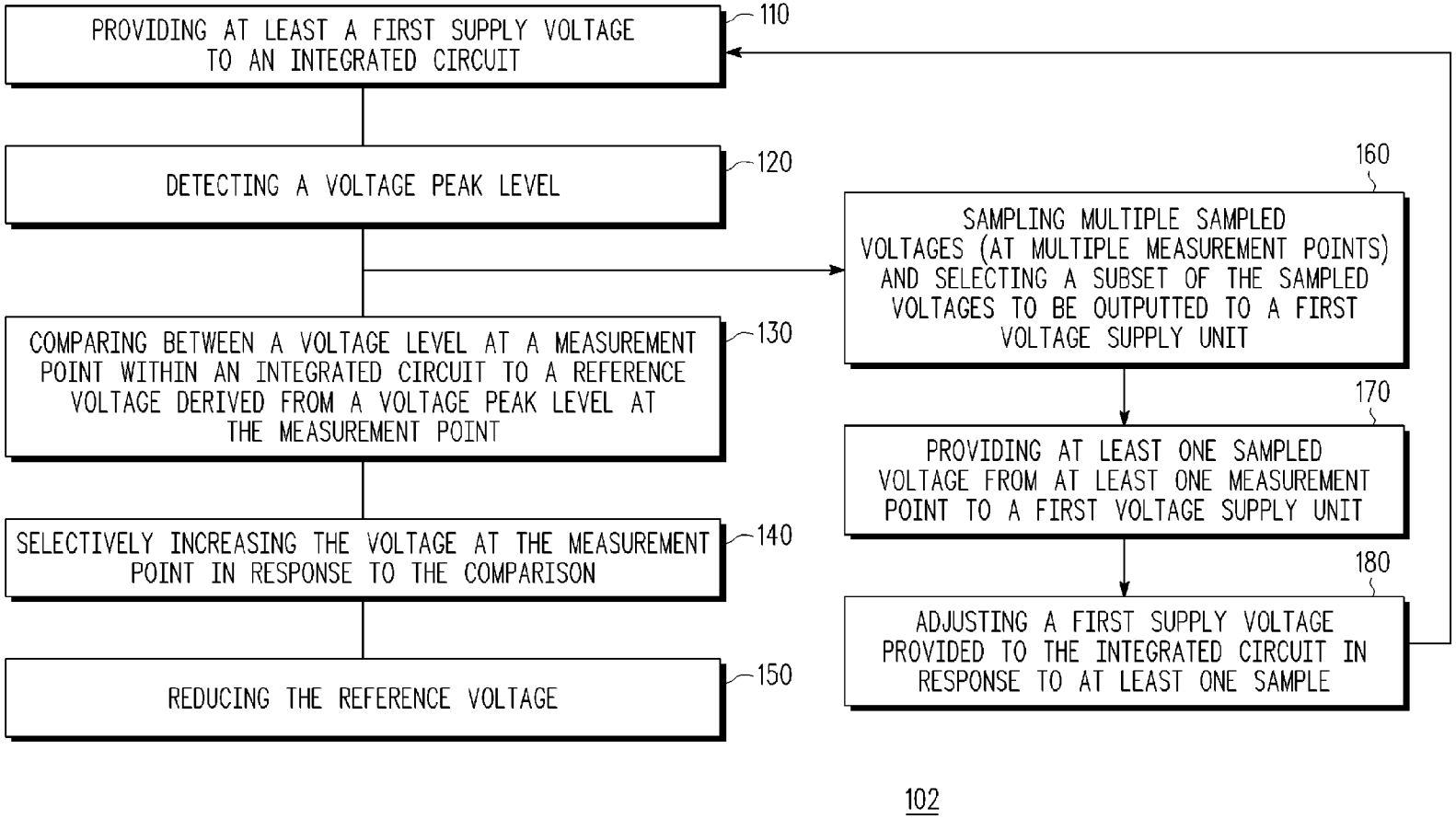
FIG. 10 is a flow chart of a method for compensating for voltage drops according to an embodiment of the invention.

FIG. 10 is a flow chart of a method 102 for compensating for voltage drops according to an embodiment of the invention.

Method 102 differs from method 100 by including additional stages 160-180. These stages can be executed in parallel to at least one stage out of stages 120-150, after one of these stages and the like.

Stage 160 includes sampling multiple sampled voltages (at multiple sensing points) and selecting a subset of the sampled voltages to be outputted to a first voltage supply unit.

Stage 160 is followed by stage 170 of providing at least one sampled voltage from at least one sensing point to the first voltage supply unit.

Stage 170 is followed by stage 180 of adjusting a first supply voltage provided to the integrated circuit in response to at least one sample. Stage 180 is followed by stage 110.

According to various embodiments of the invention method 102 can include a stage of sampling a single sampled voltage and providing it to the first voltage supply unit. According to other embodiments method 102 does not include selecting a subset but rather all the sampled voltages are provided to the first voltage supply unit.

According to other embodiments of the invention method 100 and 102 can be used to compensate for voltage drops that occur at multiple sensing points. Conveniently each sensing point is managed independently to other sensing points.

According to an embodiment of the invention stage 150 ends after stage 180 starts or even shortly after stage 180 starts. Thus, the adjusted first voltage supply voltage is provided to the integrated circuit after the compensation session of stages 130-140 ends. It is noted that the adjustment of the first supply voltage can occur at least in a partial overlapping manner with the applying of stages 130 and 140.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

We claim:

1. A method comprising:

providing at least a first supply voltage to an integrated circuit (IC);

determining a first peak voltage level at a first sensing point of the IC over a period of time;

determining a first voltage level at the first sensing point of the IC at a first time;

comparing information based on the first voltage level to information based on the first peak voltage level to determine a first voltage drop has occurred at the first sensing point; and selectively increasing the voltage at the first sensing point to compensate for the first voltage drop in response to the comparison.

2. The method of claim 1 further comprising:

determining a second peak voltage level at a second sensing point of the IC over the period of time;

determining a second voltage level at the second sensing point of the IC at a second time;

comparing information based on the second voltage level to information based on the second peak voltage level to determine that a voltage drop has not occurred at the second sensing point; and maintaining the voltage at the second sensing point, in response to the voltage drop not occurring at the second sensing point.

3. The method of claim 1 further comprising:

determining a second peak voltage level at a second sensing point of the IC over the period of time;

determining a second voltage level at the second sensing point of the IC at a second time;

comparing information based on the second voltage level to information based on the second peak voltage level to determine that a second voltage drop has occurred at the second sensing point; and selectively increasing the voltage at the second sensing point to compensate for the second voltage drop in response to the comparison, wherein the increase of the voltage at the second sensing point is greater than the increase of the voltage at the first sensing point in response to the second voltage drop being greater than the first voltage drop.

4. The method of claim 3, wherein the second voltage drop is greater than the first voltage drop in response to a first component near the second sensing point consuming more current than a second component near the first sensing point.

5. The method of claim 3 wherein the first sensing point is at a memory of the IC.

6. The method of claim 5, wherein the second sensing point is at a processor core of the IC.

7. The method of claim 1 further comprising:

consuming, by a component near the first sensing point, a larger amount of current after the first time than before the first time;

determining a second voltage level at the first sensing point of the IC at a second time based on the larger of amount current consumed;

comparing information based on the second voltage level to information based on the second peak voltage level to determine that a second voltage drop has occurred at the first sensing point at the second time; and selectively increasing the voltage at the second sensing point to compensate for the second voltage drop in response to the comparison, wherein the increase of the voltage at the second time is greater than the increase of the voltage at the first time in response to the second voltage drop being greater than the first voltage drop.

8. An integrated circuit (IC) comprising:

a first current consuming component; and a compensation circuit to determine a first peak voltage level at a first sensing point of the IC over a period of time, to determine a first voltage level at the first sensing point of the IC at a first time, to compare information based on the first voltage level to information based on the first peak voltage level to determine a first voltage drop has occurred at the first sensing point, and to selectively increase the voltage at the first sensing point to compensate for the first voltage drop in response to the comparison.

9. The IC of claim 8, the compensation circuit further to determine a second peak voltage level at a second sensing point of the IC over the period of time, to determine a second voltage level at the second sensing point of the IC at a second time, to compare information based on the second voltage level to information based on the second peak voltage level to determine that a voltage drop has not occurred at the second sensing point, and to maintain the voltage at the second sensing point, in response to the voltage drop not occurring at the second sensing point.

10. The IC of claim 8, the compensation circuit further to determine a second peak voltage level at a second sensing point of the IC over the period of time, to determine a second voltage level at the second sensing point of the IC at a second time, to compare information based on the second voltage level to information based on the second peak voltage level to determine that a second voltage drop has occurred at the second sensing point, and to selectively increase the voltage at the second sensing point to compensate for the second voltage drop in response to the comparison, wherein the increase of the voltage at the second sensing point is greater than the increase of the voltage at the first sensing point in response to the second voltage drop being greater than the first voltage drop.

11. The IC of claim 10, wherein the second voltage drop is greater than the first voltage drop in response to a second current consuming component near the second sensing point consuming more current than the first current consuming component near the first sensing point.

12. The IC of claim 10, wherein at least one of the first current consuming component and the second current consuming component is selected from a group comprising: a core, a memory, and a peripheral unit.

13. The IC of claim 8, further comprising:

a component near the first sensing point, the component to consume a larger amount of current after the first time than before the first time;

the compensation circuit to determine a second voltage level at the first sensing point of the IC at a second time based on the larger of amount current consumed by the component, to compare information based on the second voltage level to information based on the second peak voltage level to determine that a second voltage drop has occurred at the first sensing point at the second time, and to selectively increase the voltage at the second sensing point to compensate for the second voltage drop in response to the comparison, wherein the increase of the voltage at the second time is greater than the increase of the voltage at the first time in response to the second voltage drop being greater than the first voltage drop.

14. An integrated circuit (IC) comprising:

a first current consuming component;

a first sensing point of the IC located near the first current consuming component; and a compensation circuit to determine a first peak voltage level at the first sensing point of the IC over a period of time, to determine a first voltage level at the first sensing point of the IC at a first time, to compare information based on the first voltage level to information based on the first peak voltage level to determine a first voltage drop has occurred at the first sensing point, and to selectively increase the voltage at the first sensing point to compensate for the first voltage drop in response to the comparison.

15. The IC of claim 14, further comprising:

a second current consuming component; and a second sensing point of the IC located near the second current consuming component;

the compensation circuit further to determine a second peak voltage level at the second sensing point of the IC over the period of time, to determine a second voltage level at the second sensing point of the IC at a second time, to compare information based on the second voltage level to information based on the second peak voltage level to determine that a voltage drop has not occurred at the second sensing point, and to maintain the voltage at the second sensing point, in response to the voltage drop not occurring at the second sensing point.

16. The IC of claim 14, the compensation circuit further to determine a second peak voltage level at a second sensing point of the IC over a period of time, to determine a second voltage level at the second sensing point of the IC at a second time, to compare information based on the second voltage level to information based on the second peak voltage level to determine that a second voltage drop has occurred at the second sensing point, and to selectively increase the voltage at the second sensing point to compensate for the second voltage drop in response to the comparison, wherein the increase of the voltage at the second sensing point is greater than the increase of the voltage at the first sensing point in response to the second voltage drop being greater than the first voltage drop.

17. The IC of claim 16, wherein the second voltage drop is greater than the first voltage drop in response to a first component near the first sensing point consuming less current than a second component near the second sensing point.

18. The IC of claim 17, wherein the first current consuming component is a memory of the IC, and the second current consuming component is a processor core of the IC.

19. The IC of claim 14, the first current consuming component to consume a larger amount of current after the first time than before the first time;

the compensation circuit to determine a second voltage level at the first sensing point of the IC at a second time based on the larger of amount current consumed by the first current consuming component, to compare information based on the second voltage level to information based on the second peak voltage level to determine that a second voltage drop has occurred at the first sensing point at the second time, and to selectively increase the voltage at the second sensing point to compensate for the second voltage drop in response to the comparison, wherein the increase of the voltage at the second time is greater than the increase of the voltage at the first time in response to the second voltage drop being greater than the first voltage drop.

20. The IC of claim 14, wherein at least one of the first current consuming component and the second current consuming component is selected from a group comprising: a core, a memory, and a peripheral unit.

* * * * *